US010093499B2

(12) United States Patent
Kuroki et al.

(10) Patent No.: US 10,093,499 B2
(45) Date of Patent: Oct. 9, 2018

(54) SHEET CONVEYING DEVICE

(71) Applicant: BROTHER KOGYO KABUSHIKI KAISHA, Nagoya-shi, Aichi-ken (JP)

(72) Inventors: Takahiro Kuroki, Kuwana (JP); Isao Fukuchi, Gifu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/381,954

(22) Filed: Dec. 16, 2016

(65) Prior Publication Data

US 2017/0183178 A1 Jun. 29, 2017

(30) Foreign Application Priority Data

Dec. 25, 2015 (JP) ..... 2015-253971

(51) Int. Cl.
*B65H 5/38* (2006.01)
*B41J 29/02* (2006.01)
*B41J 29/13* (2006.01)

(52) U.S. Cl.
CPC ..... *B65H 5/38* (2013.01); *B41J 29/02* (2013.01); *B41J 29/13* (2013.01); *B65H 2515/82* (2013.01); *B65H 2601/521* (2013.01)

(58) Field of Classification Search
CPC ..... B65H 2601/521; B65H 2515/82; B65H 5/38; B65H 29/52; B65H 29/245; B65H 29/246; B65H 29/247
See application file for complete search history.

(56) References Cited

U.S. PATENT DOCUMENTS 5,188,353 A * 2/1993 Parks ..... B65H 31/34 271/184
6,354,588 B1 * 3/2002 Kuwahara ..... B65H 31/02 271/224
6,494,450 B2 * 12/2002 Tsurumaki ..... B65H 31/02 271/220
7,661,671 B2 * 2/2010 Yamazaki ..... B65H 29/246 271/211
8,297,748 B2 * 10/2012 Chiwata ..... B41J 3/60 271/104

(Continued)

FOREIGN PATENT DOCUMENTS

JP 2007248765 A * 9/2007 ..... G03G 15/6573
JP 2010191056 A * 9/2010 ..... B65H 5/38

(Continued)

*Primary Examiner* — Patrick Cicchino
(74) *Attorney, Agent, or Firm* — Merchant & Gould P.C.

(57) ABSTRACT

A conveying unit conveys a sheet to a tray. A first surface of a wall member and the tray define a first space. A structural member has a facing surface which faces a second surface of the wall member. A wall surface of a frame, the second surface of the wall member, and the facing surface of the structural member define a second space. The wall member has a plurality of through holes including a first through hole and a second through hole. A first imaginary plane containing an edge of the first through hole in the second surface is away from the facing surface of the structural member by a first distance, and a second imaginary plane containing an edge of the second through hole in the second surface is away from the facing surface by a second distance which is different from the first distance.

13 Claims, 8 Drawing Sheets

(56) References Cited

U.S. PATENT DOCUMENTS

| | | | | |
|---|---|---|---|---|
| 9,302,874 | B2 * | 4/2016 | Schilling | B65H 29/242 |
| 2016/0167411 | A1 * | 6/2016 | Chiwata | B41J 29/377<br>271/211 |
| 2017/0108812 | A1 * | 4/2017 | Niitsuma | B65H 5/38 |

FOREIGN PATENT DOCUMENTS

| | | | |
|---|---|---|---|
| JP | 2010274593 | A | 12/2010 |
| JP | 2015-137142 | A | 7/2015 |

* cited by examiner

SHEET CONVEYING DEVICE

CROSS-REFERENCE TO RELATED APPLICATION

This application claims priority from Japanese Patent Application No. 2015-253971, filed on Dec. 25, 2015, which is incorporated herein by reference in its entirety.

TECHNICAL FIELD

Aspects described herein relate to a sheet conveying device.

BACKGROUND

A known sheet conveying device is configured to reduce acoustic noise generated during sheet conveyance. The sheet conveying device is used in a dot line printer and includes upper and lower paper guides which are made of sheet metal and define a sheet travelling passage therebetween. A noise absorbing material is disposed along at least one of the upper and lower paper guides, which has a plurality of holes, so as to be exposed through the holes to the sheet travelling passage.

Another known sheet conveying device includes a sheet guide which defines a sheet transport path and has Helmholtz tubes. The frequency of acoustic noise to be absorbed is adjustable according to the type of a sheet.

SUMMARY

It may be beneficial to provide a sheet conveying device configured to reduce acoustic noise, generated during sheet conveyance, in a wide range of frequencies without using a noise absorbing material.

According to one or more aspects of the disclosure, a sheet conveying device comprises a tray, a conveying unit configured to convey a sheet to the tray, a wall member, a structural member, and a frame. The wall member has a first surface and a second surface opposite to the first surface. The first surface and the tray define a first space. The structural member has a facing surface which faces the second surface of the wall member. The frame has a wall surface which defines, together with the second surface of the wall member and the facing surface of the structural member, a second space. The wall member has a plurality of through holes formed therethrough and including a first through hole and a second through hole. A first imaginary plane containing an edge of the first through hole in the second surface is away from the facing surface of the structural member by a first distance, and a second imaginary plane containing an edge of the second through hole in the second surface is away from the facing surface by a second distance which is different from the first distance.

According to one or more aspects of the disclosure, a sheet conveying device comprises a tray, a conveying unit configured to convey a sheet to the tray in a conveying direction, a wall member, a structural member, and a frame. The wall member has a first surface and a second surface opposite to the first surface. The first surface and the tray define a first space. The structural member has a facing surface which faces the second surface of the wall member. The frame has a wall surface which defines, together with the second surface of the wall member and the facing surface of the structural member, a second space. The wall member includes a perforated portion having a plurality of though holes through which the first space and the second space communicate with each other. The perforated portion has a surface segment which is a part of the second surface. The surface segment and the facing surface of the structural member are inclined relative to each other. The plurality of through holes include a first through hole and a second through hole which are located at different positions in the conveying direction.

DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
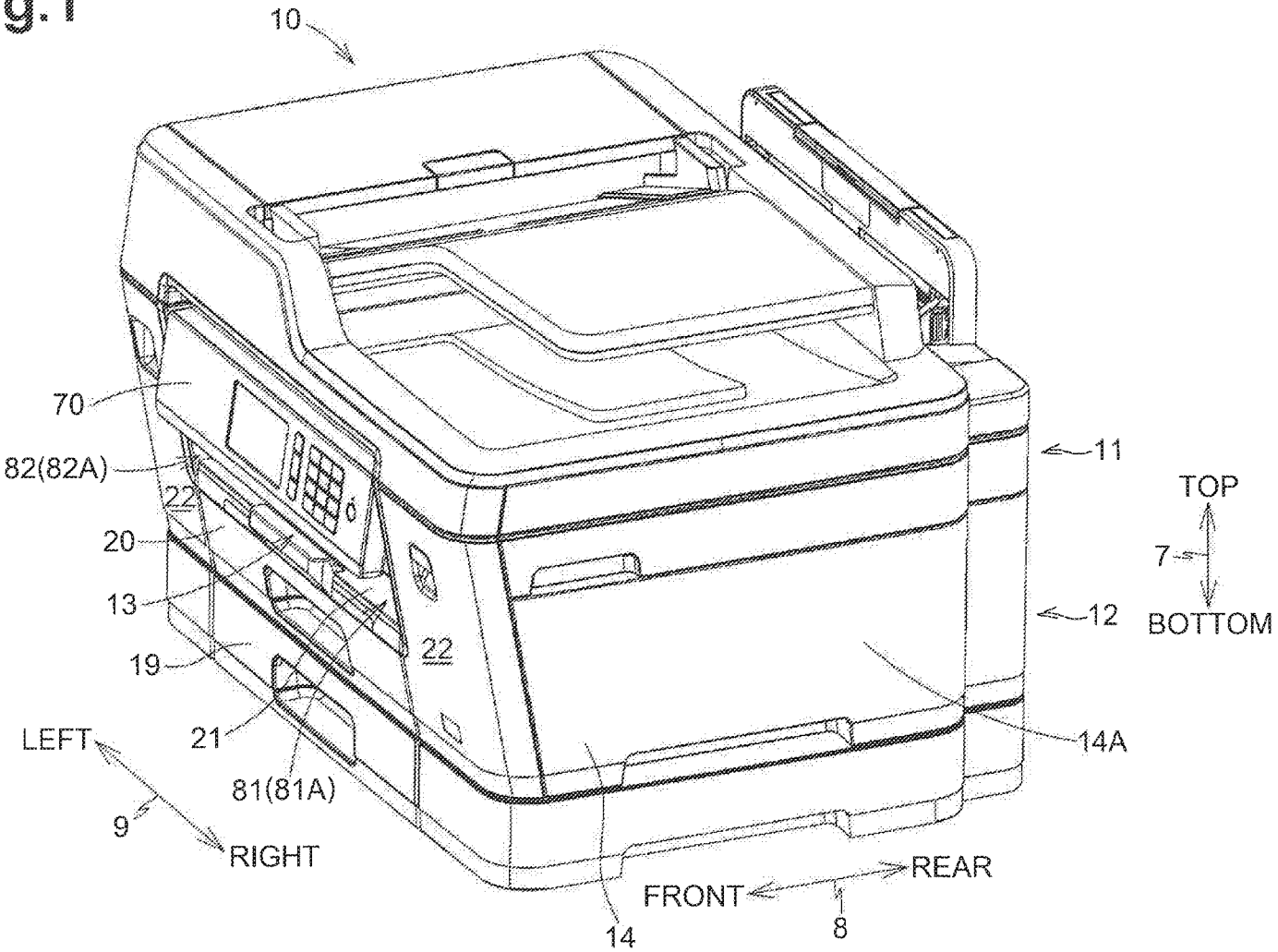
FIG. 1 is a perspective view of a multifunction device in an illustrative embodiment according to one or more aspects of the disclosure.

An illustrative embodiment according to one or more aspects of the disclosure will be described below. The disclosure is merely an example and various changes, arrangements and modifications may be applied therein without departing from the spirit and scope of the disclosure. A top-bottom direction 7 may be defined with reference to an orientation of a multifunction device 10 that may be disposed in an orientation in which it may be intended to be used (refer to FIG. 1). The side of the multifunction device 10, in which an opening 13 may be defined, may be defined as the front of the multifunction device 10. A front-rear direction 8 may be defined with reference to the front of the multifunction device 10. A right-left direction 9 may be defined with respect to the multifunction device 10 as viewed from the front of the multifunction device 10.

[Overall Configuration of Multifunction Device 10]

As shown in FIG. 1, the multifunction device 10 (an example of a sheet conveying device) includes a scanner 11 at its upper portion, and a printer 12 at its lower portion. The scanner 11 is configured to read an image of a document and retrieve image data. The printer 12 is configured to record an image on a sheet 15 (refer to FIG. 2) based on image data.

The scanner 11 may be a flatbed scanner. Details of the scanner 11 will be omitted here. The printer 12 includes a conveying device 27 and a recording unit 24 (refer to FIG. 2) configured to record an image on a sheet 15.

The conveying device 27 includes a casing 14 defining a conveying path 23 therein, feed trays 19, 20 (refer to FIGS. 1 and 2) in two layers, a feed roller 25 (refer to FIG. 2), a conveying roller pair 63 (refer to FIG. 2 as an example of a driven member), a discharge roller pair 66 (refer to FIG. 2 as an example of a conveying unit), and a discharge tray 21 (refer to FIG. 2 as an example of a tray) supported by the feed tray 20.

As shown in FIG. 1, the feed tray 20 is insertable rearward from a front face 22 into an interior of the casing 14. The feed tray 20 attached (shown in FIG. 1) into the casing 14 is removable frontward. The feed tray 20 is configured to store therein various sizes of sheets 15.

The casing 14 has an opening 13 at the front face 22. The opening 13 is defined above the feed tray 20. Details of the opening 13 will be described later.

As shown in FIG. 1, the multifunction device 10 includes an operation panel 70. The operation panel 70 is disposed above the opening 13 at the front face 22 of the casing 14. The operation panel 70 is configured to display information to be notified to a user and receive commands input by a user into the multifunction device 10. The operation panel 70 may include a liquid display, touch sensors placed on the liquid display, and pushbuttons.

Figure 2:
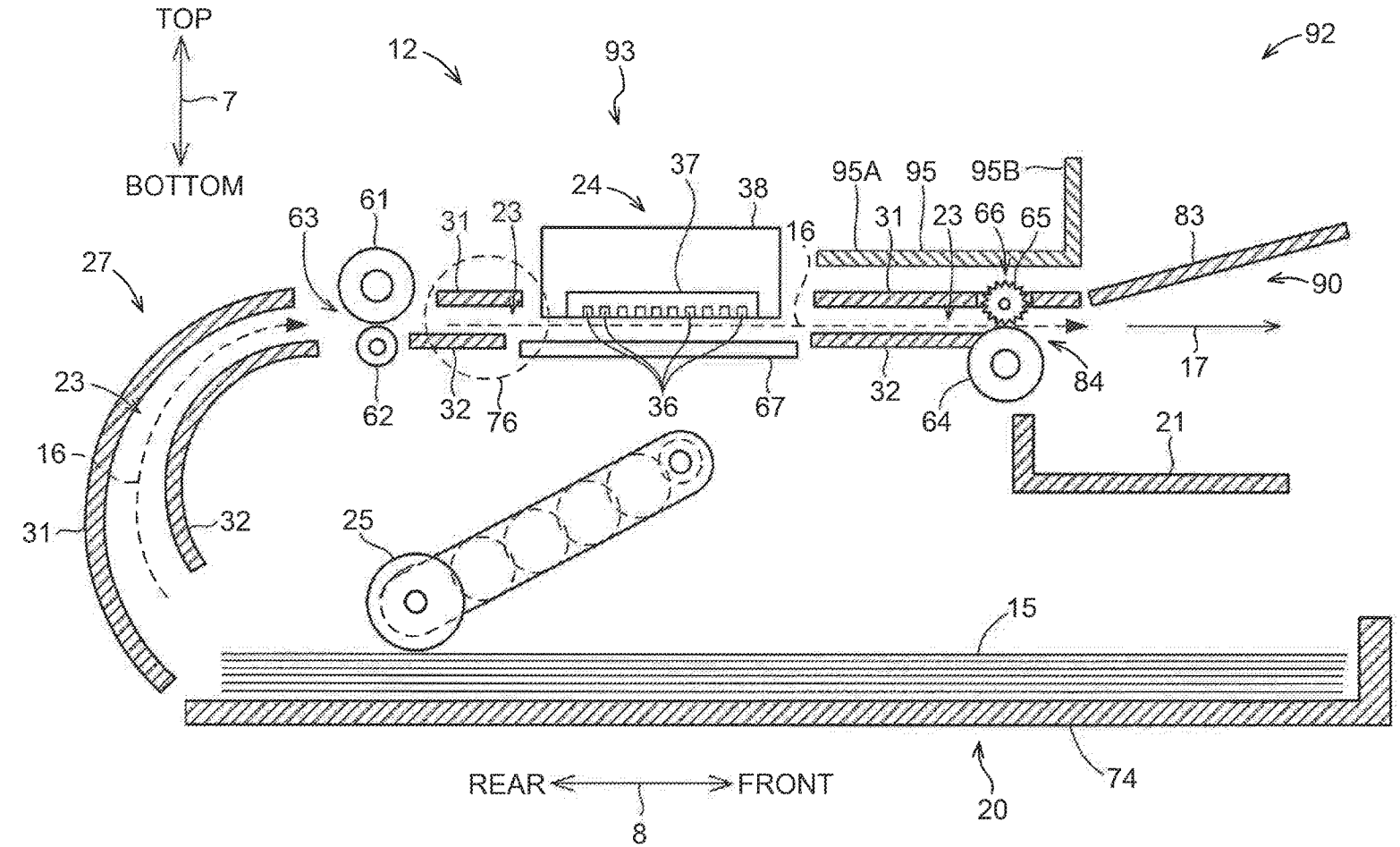
FIG. 2 is a schematic vertical sectional view showing an internal structure of a printer in the illustrative embodiment according to one or more aspects of the disclosure.

As shown in FIG. 2, the feed tray 20 includes a bottom plate 74 configured to support sheets 15 thereon, and side plates (not shown) extending upward from right and left ends of the bottom plate 74. Upon receipt of driving force from a motor 76, the feed roller 25 rotates to feed a sheet 15 supported on the bottom plate 74 to a conveying path 23.

In the illustrative embodiment, the feed tray 19 is disposed below the feed tray 20. The feed tray 19 is configured similarly to the feed tray 20. The feed tray 19 includes a bottom plate and a pair of side plates. The feed tray 19 functions similarly to the feed tray 20. The printer 12 records an image on a sheet 15 fed from the feed tray 19 similarly to when the printer 12 records an image on a sheet 15 fed from the feed tray 20. Therefore, the feed tray 19 is omitted from the figures other than FIG. 1. The feed tray 20 will be described in detail, and a repetitive description of the feed tray 19 will be omitted.

The conveying path 23 extends from a rear end of the feed tray 20 upward to form a U-turn, and extends frontward to the discharge tray 21. The conveying path 23 is defined by a first guide member 31 and a second guide member 32 which face each other with an interval therebetween. A sheet 15 is fed from the feed tray 20 to the conveying path 23 and conveyed along the conveying path 23 in a conveying direction 16 shown by a dotted line with arrows in FIG. 2.

A conveying roller pair 63 and a discharge roller pair 66 are disposed inside the casing 14. Specifically, the conveying roller pair 63 is disposed at the conveying path and upstream of a recording unit 24 in the conveying direction 16. The conveying roller pair 63 includes a conveying roller 61 and a pinch roller 62. The pinch roller 62 is pressed against a roller surface of the conveying roller 61 by an elastic member (not shown) such as a spring. The discharge roller pair 66 is disposed at the conveying path and downstream of the recording unit 24 in the conveying direction 16. The discharge roller pair 66 includes a discharge roller 64 and a spur 65. The spur 65 is pressed against a roller surface of the discharge roller 64 by an elastic member (not shown) such as a spring. Upon reception of driving force from the motor 76, the conveying roller 61 and the discharge roller 64 rotate while pinching a sheet against the pinch roller 62 and the spur respectively, thereby to convey a sheet 15 in the conveying direction 16.

The recording unit 24 is disposed inside the casing 14. Specifically, the recording unit 24 is disposed above the conveying path 23. The recording unit 24 includes a recording head 37 and a carriage 38 holding the recording head 37. The recording head 37 includes nozzles 36 for ejecting ink toward a platen 67. The ink is supplied from an ink cartridge (not shown). The platen 67 is a plate-like member for supporting thereon a sheet 15 conveyed along the conveying path 23. The platen 67 is disposed below the conveying path 23 to face the recording head 37. The carriage 38 is supported by a frame disposed inside the casing 14 to reciprocate in the right-left direction 9. When the carriage reciprocates, the recording head 37 ejects ink through the nozzles 36 toward a sheet 15 conveyed on the platen 67 along the conveying path 23, thereby to record an image on the sheet 15. In the illustrative embodiment, the recording unit 24 employs an inkjet recording method but may employ an electrophotographic recording method.

[Discharge Tray 21]

The discharge tray 21 is supported by the feed tray 20 and insertable into and removable from the casing 14 unitarily with the feed tray 20. In other words, the discharge tray 21 is supported by the casing 14 via the feed tray 20. The discharge tray 21 may be supported directly by the casing 14.

A sheet 15 supported by the feed tray 20 is fed by the feed roller 25 to the conveying path 23 and conveyed by the conveying roller pair 63 to the recording unit 24 which performs image recording. The sheet 15 having an image recorded thereon is conveyed forward by the discharge roller pair 66 to be discharged onto the discharge tray 21.

[Right Wall Member 81, Left Wall Member 82, and Upper Wall Member 83]

Figure 3:
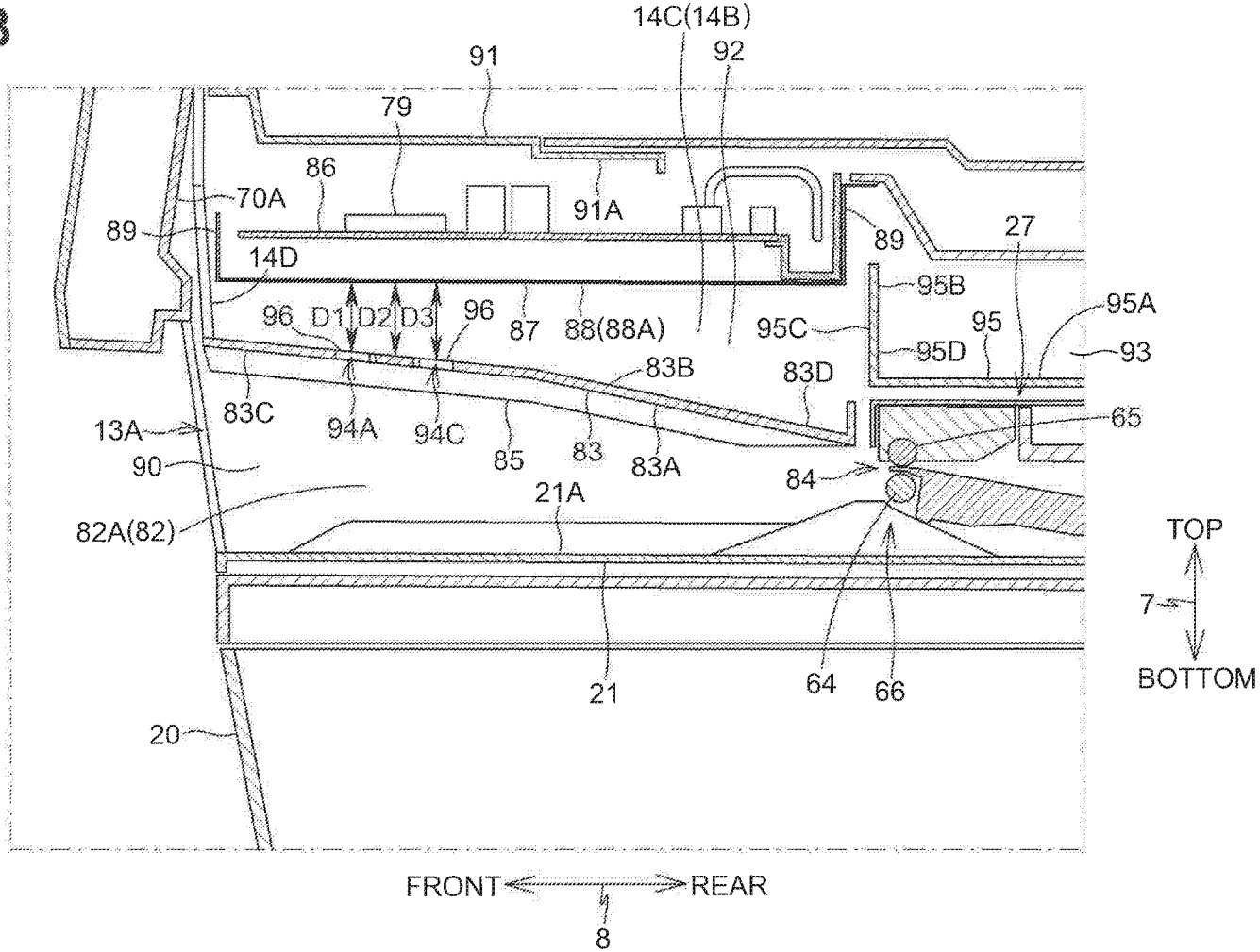
FIG. 3 is a vertical sectional view of a discharge tray, an upper wall member, an electronic board, and a shield plate in the illustrative embodiment according to one or more aspects of the disclosure.

As shown in FIGS. 1 and 3, the casing 14 includes a right wall member 81 (refer to FIG. 1), a left wall member 82 (refer to FIG. 1), and an upper wall member 83 (refer to FIG. 3 as an example of a wall member).

The right wall member 81 is shaped like a flat plate extending in the top-bottom direction 7 and in the front-rear direction 8. A front end of the right wall member 81 is connected to the front face of the casing 22. A left-facing surface of the right wall member 81 is defined as a left surface 81A, and a right-facing surface of the right wall member 81 is defined as a right surface (not shown). The left surface 81A extends, in the top-bottom direction 7, from right ends of the feed trays 19, 20 and the discharge tray 21.

The left surface 81A of the right wall member 81 extends to a position above the discharge tray 21.

The left wall member 82 is shaped like a flat plate extending in the top-bottom direction 7 and in the front-rear direction 8. A front end of left wall member 82 is connected to the front face of the casing 22. A right-facing surface of the left wall member 82 is defined as a right surface 82A, and a left-facing surface of the left wall member 82 is defined as a left surface (not shown). The left surface 81A of the left wall member 82 extends, in the top-bottom direction 7, from left ends of the feed trays 19, 20 and the discharge tray 21. The left surface 81A extends to a position above the discharge tray 21. The feed trays 19, 20 are in contact with the left surface of 81A of the right wall member 81 and the right surface 82A of the left wall member 82.

The upper wall member 83 is shaped like a flat plate extending substantially in the front-rear direction 8 and in the right-left direction 9. The upper wall member 83 is connected to an upper end of the right wall member 81 and an upper end of the left wall member 82. The upper wall member 83 has a substantially uniform thickness in the top-bottom direction 7. The upper wall member 83 has a lower surface 83A which faces down toward the discharge tray 21, and an upper surface 83B which faces up and is opposite to the lower surface 83A. The lower surface 83A of the upper wall member 83 is an example of a first surface, and the upper surface 83B is an example of a second surface. The upper wall member 83 is inclined such that a front end portion 83C is higher than a rear end portion 83D. The front end portion 83C is positioned at a substantially same position as an upper edge of the opening 13.

As shown in FIGS. 2 and 3, the multifunction device 10 has a discharge port 84. The discharge roller pair 66 may include a plurality of discharge rollers 64 arranged at intervals in the right-left direction 9, and a plurality of spurs 65 arranged at intervals in the right-left direction 9. The discharge port 84 is a space defined adjacent to nip positions between the discharge rollers 64 and the spurs 65. In other words, the discharge port 84 is a space defined between the right surface 82A of the left wall member 82 and the lift surface 81A of the right wall member 81 and not occupied by the discharge rollers 64 and the spurs 65. A sheet 15 conveyed by the discharge rollers 64 and the spurs 65 while being nipped therebetween is discharged, via the discharge port 64, onto a receiving surface 21A of the discharge tray 21.

As shown in FIGS. 1 and 3, the multifunction device 10 has the opening 13. The opening 13 is defined by a lower end of a rear surface 70A of the operation panel 70, a front end of the left surface 81A of the right wall member 81, a front end of the right surface 82A of the left wall member 82, and a front end of the receiving surface 21A of the discharge tray 21. The opening 13 is larger than the discharge port 84.

[Ribs 85]

Figure 4:
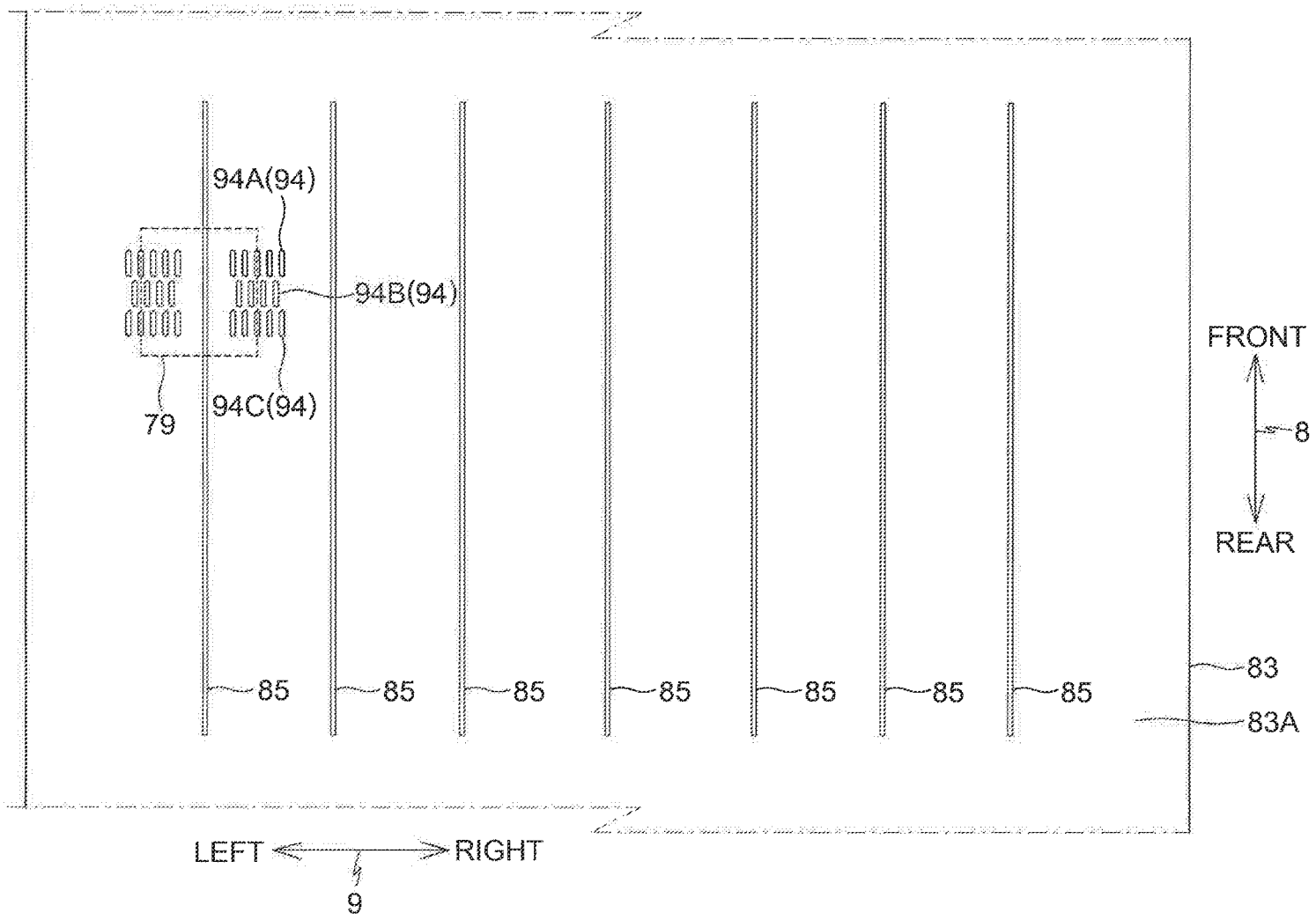
FIG. 4 is a plan view of a lower surface of the upper wall member in the illustrative embodiment according to one or more aspects of the disclosure.

As shown in FIGS. 3 and 4, the upper wall member 83 includes a plurality of ribs 85. The ribs 85 protrude downward from the lower surface 83A of the upper wall member 83 and extend parallel to each other in the front-rear direction 8. In other words, the ribs 85 extend along the conveying direction 16 in which a sheet 15 is conveyed by the discharge roller pair 66. The ribs 85 are arranged at intervals in the right-left direction 9. As will be described in detail later, through holes 94 are formed at a front-left end portion of the upper wall member 83 without interfering with the ribs 16.

[Electronic Board 86]

As shown in FIG. 3, the multifunction device 10 includes an electronic board 86 (an example of a structural member) for electronic control of the multifunction device 10. The electronic board 86 includes, as an example of a processor, a central processing unit (CPU) 79 and various electronic elements. The CPU 79 and the electronic elements may be disposed on an upper surface and/or a lower surface of the electronic board 86. The CPU 79 may be replaced with an application specific integrated circuit (ASIC), which is an example of a processor. The electronic board 86 is disposed, above the upper wall member 83, at a position facing the front-left end portion of the upper wall member 83. In other words, the electronic board 86 is disposed overlapping the front-left end portion of the upper wall member 83 when viewed in the top-bottom direction 7.

[Shield Plate 87]

As shown in FIG. 3, the multifunction device 10 includes a shield plate 87. The shield plate 87 includes a first plate segment 88 and second plate segments 89. The first plate segment 88 is disposed below the electronic board 86 and above the upper wall member 83 and faces the electronic board 86. The first plate segment 88 has a lower surface 88A (an example of a facing surface) perpendicular to the top-bottom direction 7. The first plate segment 88 extends beyond ends of the electronic board 86 in the front-rear direction 8 and in the right-left direction 9. The second plate segments 89 extend upward from front, rear, right, and left ends of the first plate segment 88 to positions slightly above respective ends of the electronic board 86, while leaving a clearance around the respective ends of the first plate segment 88. The shield plate 87, which may be made of a steel plate, shields electromagnetic interference from the electronic board 86.

[First Space 90]

A first space 90 is defined in the multifunction device 10 substantially by the receiving surface 21A of the discharge tray 21, the lower surface 83A of the upper wall member 83, the left surface 81A of the right wall member 81, the right surface 82A of the left wall member 82, the opening 13, and the discharge port 84.

[Second Space 92]

As shown in FIG. 3, the multifunction device 10 includes a lower frame 91 and an inner frame 95. The lower frame 91 is disposed below the scanner 11 and covers, from above, an interior of the multifunction device 10. The lower surface 91A of the lower frame 91 extends horizontally along the front-rear direction 8 and the right-left direction 9. The lower frame 91 is disposed above the electronic board 86. The inner frame 95 (an example of a frame) includes a horizontal plate portion 95A and a vertical plate portion 95B. The horizontal plate portion 95A is positioned above the conveying unit 27 to face the conveying unit 27. The vertical plate portion 95B extends upward from a front end of the horizontal plate portion 95A. The vertical plate portion 95B is positioned above the discharge port 84.

A second space 92 is defined substantially by the lower surface 88A of the shield plate 87, the lower surface 91A of the lower frame 91, the upper surface 83B of the upper wall member 83, a front wall 14D of the casing 14, a front surface 95C (an example of a wall surface) of the vertical plate portion 95B of the inner frame 95, a left surface 14B (refer to FIG. 3) of the a right wall 14A (refer to FIG. 1) of the casing 14, and a right surface 14C (refer to FIG. 3) of a left wall of the casing 14. The front wall 14D of the casing 14 is positioned behind the operation panel 70. Hereinafter, the front surface 95C of the vertical plate portion 95B of the inner frame 95 may be merely referred to as the "front surface of the inner frame 95". The second space 92 is a substantially closed space. A substantially closed space indicates a space closed to such a degree that, if air occupying the second space 92 is compressed, the compressed air will be pushed back by the members defining the second space 92 without flowing out of the second space 92 quickly.

[Third Space 93]

In the multifunction device 10, a third space 93 is defined behind an imaginary plane containing a rear surface 95D of the vertical plate portion 95B of the inner frame 95. The conveying unit 27 is disposed in the third space 93. The third space 93 is positioned closer to the rear of the casing 14 than the first space 90. The third space 93 and the first space 90 communicate with each other via the discharge port 84.

[Through Holes 94]

As shown in FIGS. 3 and 4, the upper wall member 83 includes a perforated portion having a plurality of through holes 94. The second space 92 and the first space 90 communicate with each other via the through holes 94. The perforated portion has a surface segment which is a part of the upper surface 83B and is inclined relative to the lower surface 88A of the first plate segment 88 of the shield plate 87. Each through hole 94 is oval. A dimension of each though hole 94 in the front-rear direction 8 is larger than a dimension of each through hole 94 in the right-left direction 9. The through holes 94 are identical in shape with each other. The through holes 94 are formed at a front-left end portion of the upper wall member 83 without interfering with the ribs 85. The perforated portion having the through holes 94 may face up toward the electronic board 86 or may preferably face up toward the CPU 79. Specifically, the through holes 94 are arranged in three rows at different positions from each other in the front-rear direction 8 while each row extends in the right-left direction 9. Each through hole 94 in the foremost row is aligned with a corresponding through hole 94 in the rearmost row in the front-rear direction 8. Each through hole 94 in the middle row is positioned, in the right-left direction 9, between corresponding adjacent two through holes 94 in the foremost or rearmost row.

An imaginary plane 96 containing edges of the through holes 94 in the foremost row on the upper surface 83B of the upper wall member 83 is away, by a first distance D1, from the lower surface 88A of the first plate segment 88 of the shield plate 87. An imaginary plane 96 containing edges of the through holes 94 in the middle row on the upper surface 83B of the upper wall member 83 is away, by a second distance D2, from the lower surface 88A of the first plate segment 88 of the shield plate 87. An imaginary plane 96 containing edges of the through holes 94 in the rearmost row on the upper surface 83B of the upper wall member 83 is away, by a third distance D3, from the lower surface 88A of the first plate segment 88 of the shield plate 87. The distance D1 is smaller than the distance D2. The Distance D2 is smaller than the distance D3. Hereinafter, a distance in the top-bottom direction 7 between an imaginary plane 96, which contains an edge of a through hole 94 on the upper surface 83B of the upper wall member 83, and the lower surface 88A of the first plate segment 88 of the shield plate 87 may be merely referred to as a "distance between the through hole 94 and the lower surface 88A of the shield plate 87".

[Helmholtz Resonance]

Sound or acoustic noise having a particular frequency may be absorbed using the Helmholtz resonance effect. Helmholtz resonance occurs in a container with an aperture, where air inside the container acts as a spring and air inside the aperture acts as mass.

[Application of Helmholtz Resonance]

In the multifunction device 10, the second space 92 is a cavity having a plurality of apertures which are the though holes 94. The second space 92 may be considered as an assembly of a plurality of Helmholtz resonators. Accordingly, it may be considered that acoustic noise generated by the conveying unit 27 in the third space 93, which is to be emitted to an exterior of the multifunction device 10 from the opening 13 through the first space 90, is absorbed by a structure including the second space 92 and the through holes 94.

The resonant frequency f [Hz] of a Helmholtz resonator in the multifunction device 10 is given by the following equation:

$$f = \frac{c}{2\pi}\sqrt{\frac{P}{(l+\delta)L}}$$

where c [m/s] is the speed of sound; P is the aperture ratio; δ is the end correction; l [m] is the thickness of a through hole 94, and L [m] is the thickness of the cavity, which is considered as the distance between the through hole 94 and the lower surface 88A of the shield member 87.

Figure 5:
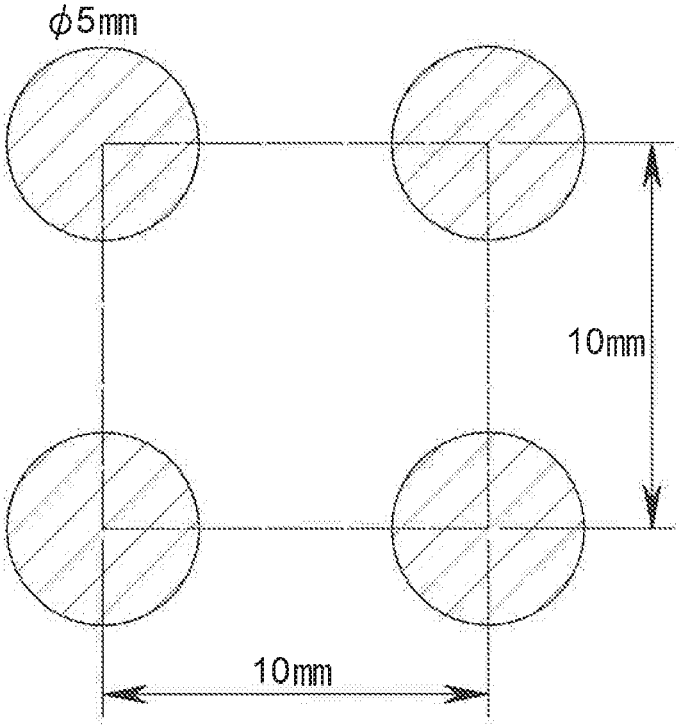
FIG. 5 is a diagram showing how to calculate an aperture ratio in the illustrative embodiment according to one or more aspects of the disclosure.

Assume, as shown in FIG. 5, that four through holes 94, each being circular and having an inner diameter of 5 [mm], are arranged such that respective centers of the through holes 94 are away from one another by 10 [mm] in the front-rear direction 7 and in the right-left direction 9. In this case, the aperture ratio P is $(2.5^2\times\pi)/10^2\approx0.2$. The end correction may, for example, be set to "the inner diameter of the through hole 94×0.6". A Helmholtz resonator is provided separately for each through hole 94. Thus, the distance L between a through hole 94 and the lower surface 88A varies to be the distance D1, D2, or D3, each of which is measured in the top-bottom direction 7 from an imaginary plane containing an edge of a through hole 94 to the lower surface 88A of the first plate segment 88 of the shield plate 87. Each of the distances D1, D2, and D3 is an average distance from an imaginary plane containing an edge of a through hole 94 to the lower surface 88A of the shield plate 87.

When the distance L from an imaginary plane containing an edge of a through hole 94 to the lower surface 88A of the first plate segment 88 varies from one point to another point of the edge, an average distance should be calculated using the area ratio of the imaginary plane. For example, suppose that a first region of an edge of a though hole has an area ratio r1 to the total area of the edge of the through hole and a distance from an imaginary plane containing each point, in the first region, of the edge of the though hole to the lower surface 88A is d1, and suppose that a second region of an edge of a though hole has an area ratio r2 to the total area of the edge of the through hole and a distance from an imaginary plane containing each point, in the second region, of the edge of the though hole to the lower surface 88A is d2. In this case, the distance L is calculated as an average distance by r1×d1+r2×d2. However, instead of the calculating an average distance, the distance L may be obtained by measuring from a central position of an imaginary plane containing an edge of a though hole 94 to the lower surface 88A, or the distance L may be set to a distance by which most of points of an edge of a through hole are away from the lower surface 88A. For example, when the upper surface 83 B having through holes 94 is inclined at a constant angle, a distance from a central position of an imaginary plane containing an edge of one of the through holes 94 to the lower surface 88A may be considered as the distance L from an imaginary plane containing the edge of the one of the through holes to the lower surface 88A.

In the multifunction device 10, the upper wall member 83 is inclined such that the front end portion 83C, which is adjacent to the opening 13, is positioned above the rear end portion 83D in the top-bottom direction 7. Thus, a though hole 94 positioned closer to the front is away from the first plate segment 88 of the shield plate 87 by a smaller distance in the top-bottom direction 7. In other words, the distance D1 is smaller than the distance D2 which is smaller than the distance D3. Each of the distances D1, D2, and D3 corresponds to the thickness L of a cavity of a Helmholtz resonator. Thus, a through hole 94 positioned closer to the front is associated with a cavity having a smaller thickness L. The multifunction device 10 has a plurality of cavities which are associated with respective through holes 94 and have different thicknesses L. Thus, it is considered that the multifunction device 10 absorbs acoustic noise with a plurality of resonant frequencies F which correspond to a plurality of thicknesses L.

Figure 8:
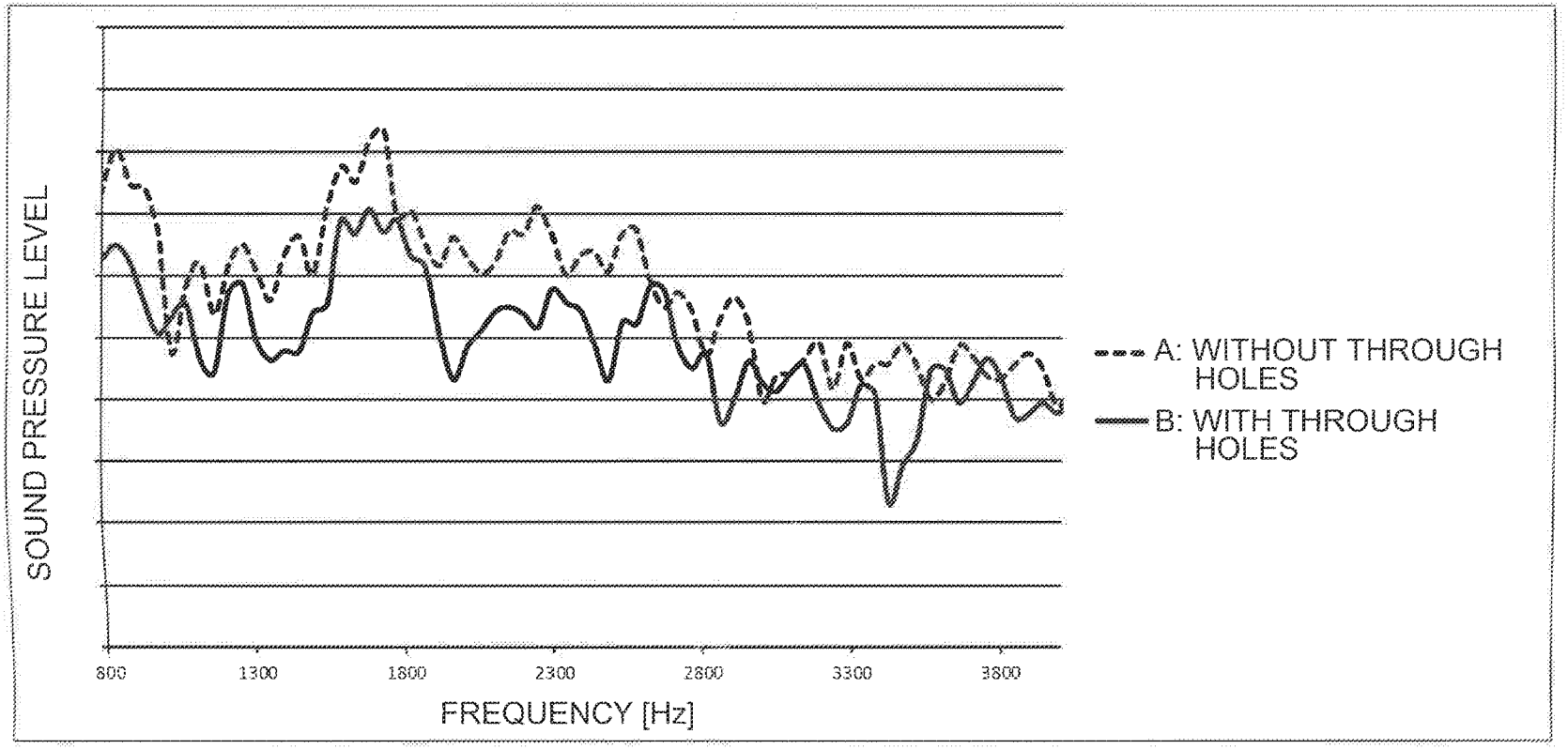
FIG. 8 is a graph showing results of spectral analysis of sheet conveying noise in the multifunction device with/without through holes in the upper wall member in the illustrative embodiment according to one or more aspects of the disclosure.

FIG. 8 is a graph showing results from the spectrum analysis of acoustic noise, in a range of frequencies from about 800 [Hz] to about 3800 [Hz], generated during the time period where a sheet 15 is conveyed in the multifunction device 10. A broken line A shows a result from measuring acoustic noise generated in the multifunction device 10 which includes the upper wall member 83 without through holes 94. A solid line B shows a result from measuring acoustic noise generated in the multifunction device 10 which includes the upper wall member 83 with through holes 94. As shown in FIG. 8, the solid line B is below the broken line A in a substantially entire range of frequencies. Specifically, the sound pressure level of acoustic noise generated in the multifunction device 10 which includes the upper wall member 83 with through holes 94 is less, in the substantially entire range of frequencies, than the sound pressure level of acoustic noise generated in the multifunction device 10 which includes the upper wall member 83 without through holes 94. The above-described measurements showed a result that acoustic noise absorbing effect is obtained in a wide range of frequencies when the upper wall member 83 is inclined relative to the shield plate 87 such that the distances D1, D2, and D3 between respective through holes 94 and the shield plate 87 are different.

[Effects Obtained by Illustrative Embodiment]

According to the illustrative embodiment, the multifunction device 10 has the second space 92 which is almost closed and defined by the upper surface 83B of the upper wall member 83, the lower surface 88A of the shield plate 87, the front surface 95C of the inner frame 95, and the inner surface of the casing 14. The second space 92 communicates with the first space 90 via the through holes 94. Thus, the structure formed by the upper wall member 83, the shield plate 87, the inner frame 95, and the casing 14 is considered similar to the structure of a Helmholtz resonator. An imaginary plane containing an edge of a through hole 96 closer to the opening 13 is away from the lower surface 88A of the shield plate 87 by a smaller distance. This allows the multifunction device 10 to simultaneously absorb acoustic noise with a plurality of frequencies which correspond to a plurality of distances between the through holes 96 and the lower surface 88A. Consequently, the multifunction device 10, which is not provided with a noise absorbing material, reduces acoustic noise in a wide range of frequencies.

The front end portion 83C of the lower surface 83A of the upper wall member 83 is farther from the discharge tray 21 than the rear end portion 83D. The space above the discharge tray 21 is wider at the front than at the rear. This allows a user to take a sheet 15 from the discharge tray 21 readily through the opening 13.

The through holes 94 are located within a particular area of the upper wall member 83. The particular area faces the lower surface 88A of the shield plate 87 in the top-bottom direction 7. Air passes through the through holes 94 between the first space 90 and the second space 92. Thus, air heated by the heat emitted by the electronic board 86 is emitted out of the second space 92 via the through holes 94 and gaps. This facilitates effective heat emission from the electronic board 86.

The electronic board includes the CPU 79, which is relatively heat-emitting and heat-sensitive as compared to other electronic elements and an integral circuit (IC). At least a part of the through holes 94 is located in the upper wall member 83 to face an area of the electronic board 86 occupied by the CPU 79. This facilitates effective heat emission from the CPU 79.

Each of the though holes 94 is oval and a dimension thereof in the front-rear direction 8 is larger than a dimension in the right-left direction 9. The through holes 94 are likely to prevent a sheet 15, when discharged onto the discharge tray 21, from getting stuck in the through holes 94.

The through-holes 94 are formed only at the left-front area of the upper wall member 83*a* and no through-holes are formed at the remaining area. The though holes 94, which are partially formed in the upper wall member 83, are less likely to reduce the strength of the upper wall member 83.

The upper wall member 83 includes the ribs 85 which protrude from the lower surface 83A toward the discharge tray 21 and extend in the front-rear direction 8. The through holes 94 are located adjacent to the ribs 85. The ribs 85 are likely to prevent a sheet 15 from approaching the through holes 94 and prevent a sheet 15, when discharged onto the discharge tray 21, from getting stuck in the though holes 94. Also, the ribs 85 extending in the front-rear direction 8 are likely to prevent a sheet 15 from getting stuck at the ribs 85.

The upper wall member 83 and the inner frame 95 define the first space 90, the second space 92 in which the electronic board 86 and the shield plate 87 are located, and the third space 93 in which the motor 76 and the conveying roller pair 63 are located. Acoustic noise generated by the motor 76 and the conveying roller pair 63 leaks from the third space 93 to the first space 90 and vibrates air in the through holes 94 to thereby resonate with the air. Consequently, this structure absorbs the acoustic noise and reduces leakage of the acoustic noise to an exterior of the multifunction device 10 through the opening 13.

[Variations]

Figure 6A:
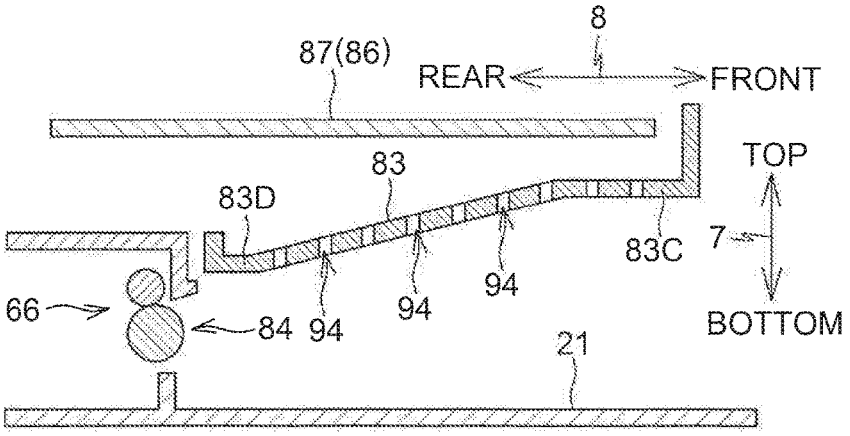
FIG. 6A is a schematic vertical cross-sectional view showing positional relation between a discharge tray, the upper wall member, and the shield plate in the illustrative embodiment, where the upper wall member is inclined such that a front end portion thereof is farther from the discharge tray than a rear end portion thereof.

According to the above-described illustrative embodiment, as shown in FIGS. 3 and 6A, the shield plate 87 is disposed horizontally without being inclined relative to the front-rear direction 8, and the upper wall member 83 is inclined such that the front end portion 83C is positioned above the rear end portion 83D. One of through holes 94 is away, by the distance D1, from the lower surface 88A of the first plate segment 88 of the shield plate 87, and another one of the through holes is away, by the distance D2, from the lower surface 88A. The distance D1 is different from the distance D2. However, as long as one of though holes 94 and another one of the through holes 94 are away, by the distance D1 and the distance D2 respectively, from the lower surface 88A of the first plate segment 88 of the shield plate 87, the positional relationship between the shield plate 87 and the upper wall member 83 may be changed from that shown in FIGS. 3 and 6A.

Figure 6B:
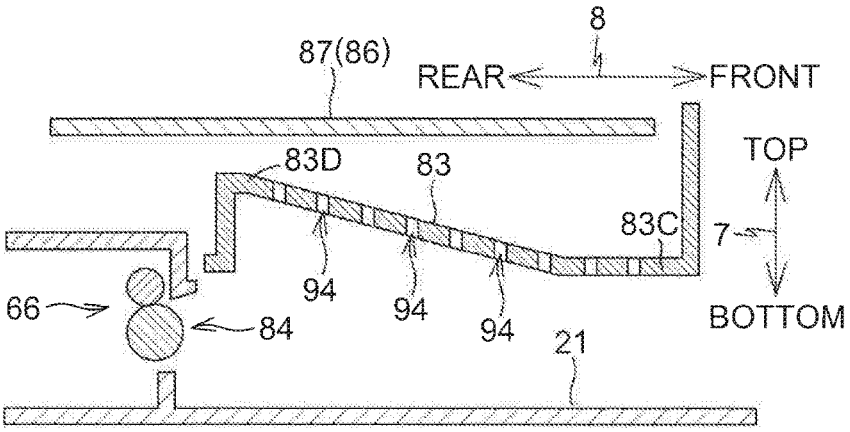
FIG. 6B is a schematic vertical cross-sectional view showing positional relation between a discharge tray, the upper wall member, and a shield plate in a variation of the illustrative embodiment, where the upper wall member is inclined such that a front end portion thereof is closer to the discharge tray than a rear end portion thereof.

For example, as shown in FIG. 6B, a shield plate 87 may be disposed horizontally while an upper wall member 83 may be disposed in an inclined manner such that a front end portion thereof is closer to a discharge tray 21 than a rear end portion thereof. In this case, a space above the discharge tray 21 becomes gradually narrow toward an opening 13, thereby reducing transmission of acoustic noise over the discharge tray 21 to an exterior through the opening 13.

Figure 6C:
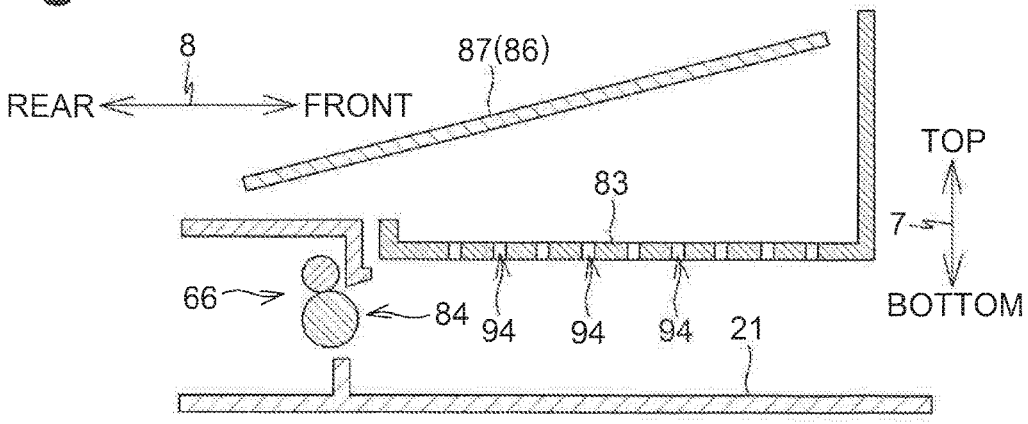
FIG. 6C is a schematic vertical cross-sectional view showing positional relation between a discharge tray, the upper wall member, and a shield plate in a variation of the illustrative embodiment, where a first wall segment of the shield plate is inclined such that a first end portion thereof is farther from the upper wall member than a rear end portion thereof.

Alternatively, as shown in FIG. 6C, an upper wall member 83 may be disposed horizontally while a shield plate 87 may be disposed in an inclined manner such that a front end portion thereof is farther from the upper wall member 83 than a rear end portion thereof.

Alternatively, although no figure is shown, an upper wall member 83 and a shield plate 87 may be disposed obliquely at different angles.

Instead of disposing the upper wall member 83 and the shield plate 87 such that distances between through holes 94 and the shield plate 87 simply increase or decrease when viewed from the rear to the front, an upper wall 83 and a shield plate 87 may be configured such that distances between through holes 94 and the shield plate 87 irregularly increase and decrease when viewed from the rear to the front.

Other than the shield plate 87 and the electrical plate 86, a structural member such as the casing 14, a cover, or a frame of the multifunction device 10 may face the through holes 94 in the top-bottom direction 7.

Figure 7:
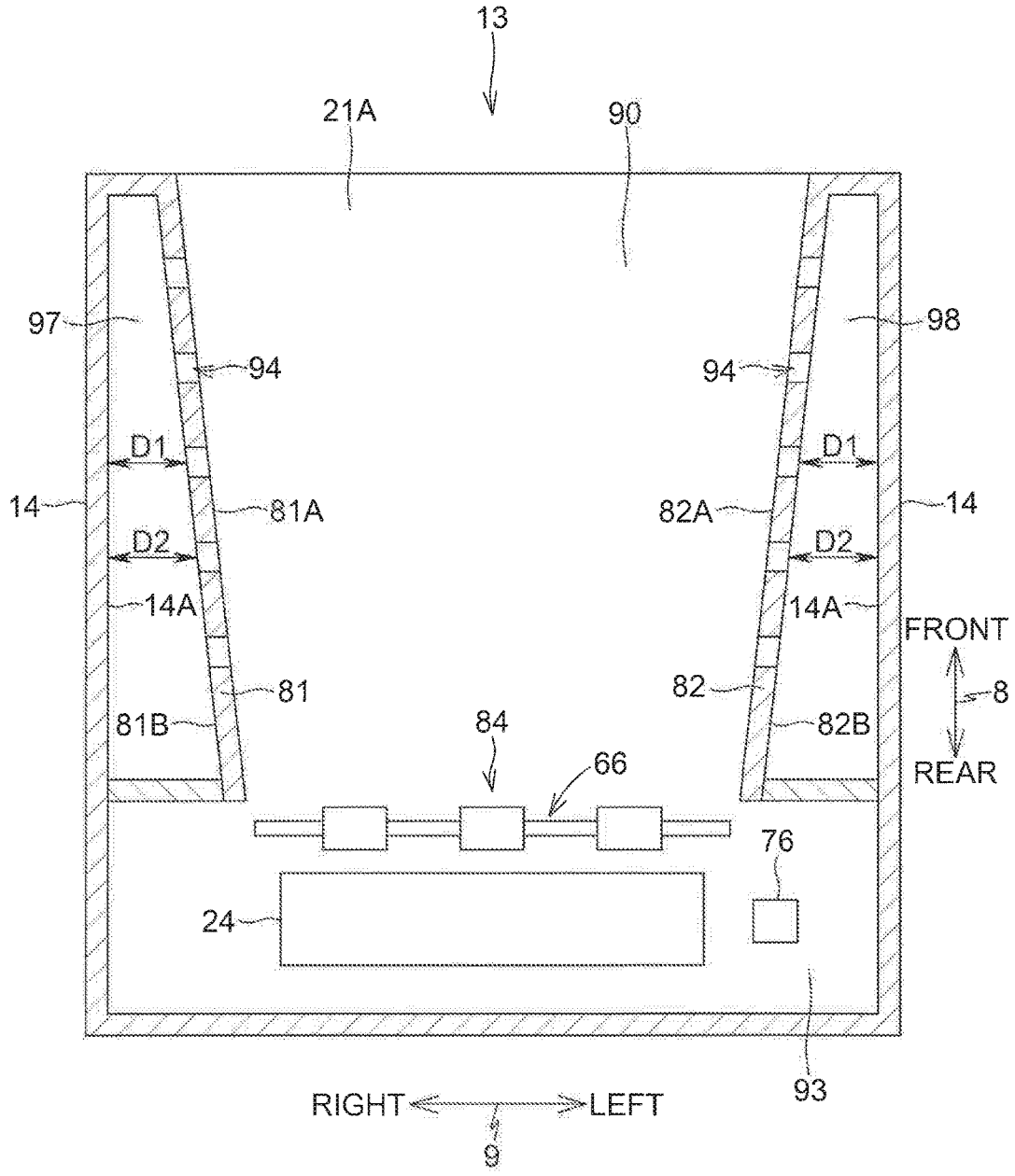
FIG. 7 is a horizontal cross-sectional view showing positional relation between a discharge tray, a right wall member, and a left wall member in a variation of the illustrative embodiment.

In the illustrative embodiment shown in FIGS. 3 and 6A and the variations shown in FIGS. 6B and 6C, the upper wall member 83 has the through holes 94. However, as shown in FIG. 7, a right wall member 81 and/or a left wall member 82 may have through holes 94.

When the right wall member 81 has the through holes 94, the right wall member 81, a left surface 81A, and a right surface 81B are examples of a wall member, a first surface, and a second surface, respectively. In this case, a mostly closed space 97 (as an example of a second space) is defined to the right of the right wall member 81. A surface (as an example of a facing surface) of a structural member, e.g., an inner surface 14A of a casing 14, faces the right surface 81B of the right wall member 81 to define the space 97. One of the through holes 94 is away, by a distance D1, from the inner surface 14A, and another one of the through holes 94 is away, by a distance D2, from the inner surface 14A. The distance D1 is different from the distance D2.

When the left wall member 82 has the through holes 94, the left wall member 82, a right surface 82A, and a left surface 82B are examples of a wall member, a first surface, and a second surface, respectively. In this case, a mostly closed space 98 (as an example of a second space) is defined to the left of the left wall member 82. A surface (as an example of a facing surface) of a structural member, e.g., the inner surface 14A of the casing 14, faces the left surface 82B of the right wall member 82 to define the space 98. One of the through holes 94 is away, by a distance D1, from the inner surface 14A, and another one of the through holes is away, by a distance D2, from the inner surface 14A. The distance D1 is different from the distance D2.

In the illustrative embodiment shown in FIG. 3 and the variations shown in FIGS. 6B and 6C, the right wall member 81 and the left wall member 82 are provided. However, either or both of the right wall member 81 and the left wall member 82 may not be provided. A right end portion and/or a left end portion of the discharge tray 21 may be open upward such that sheets 15 on the discharge tray 21 can be taken out through the opening 13 and these open right/left end portions.

The through holes 94 may not be necessarily provided under the electronic board 86 and the shield plate 87. When neither the electronic board 86 nor the shield plate 87 are provided, resonant frequencies depend on distances between respective through hole 94 and a structural member, such as the casing 14, a cover, or a frame of the multifunction device 10, disposed vertically above the through holes 94.

The through holes 94 may be positioned arbitrarily, instead of being positioned at a portion of the upper wall member 83. For example, the through holes 94 may be distributed across a wide area of the upper wall member 83.

The second space 92 in the illustrative embodiment shown in FIG. 3, and the space 97 and/or the space 98 in the variation shown in FIG. 7 may be filled with a noise absorbing material to absorb acoustic noise in a wide range of frequencies and enhance the noise absorbing effect.

While the disclosure has been described in detail with reference to the specific embodiments thereof, these are merely examples, and various changes, arrangements and modifications may be applied therein without departing from the spirit and scope of the disclosure.

What is claimed is:

1. A sheet conveying device comprising:

a tray;

a conveying unit configured to convey a sheet to the tray in a conveying direction;

a wall member having a first surface and a second surface opposite to the first surface, the first surface and the tray defining a first space;

a structural member having a facing surface which faces the second surface of the wall member; and a frame having a wall surface which defines, together with the second surface of the wall member and the facing surface of the structural member, a second space;

wherein the wall member has a plurality of through holes formed therethrough and including a first through hole and a second through hole which are located at different positions in the conveying direction, and a first imaginary plane extending in the conveying direction and containing an edge of the first through hole in the second surface is away from the facing surface of the structural member by a first distance, and a second imaginary plane extending in the conveying direction and containing an edge of the second through hole in the second surface is away from the facing surface by a second distance which is different from the first distance.

2. The sheet conveying device according to claim 1, further comprising a casing having an opening through which the first space communicates with an exterior of the casing, wherein the conveying unit is configured to convey the sheet toward the opening in the conveying direction, and a downstream end of the first surface of the wall member in the conveying direction is farther from the tray than an upstream end of the first surface.

3. The sheet conveying device according to claim 1, further comprising a casing having an opening through which the first space communicates with an exterior of the casing, wherein the conveying unit is configured to convey the sheet toward the opening in the conveying direction, and a downstream end of the first surface of the wall member in the conveying direction is closer to the tray than an upstream end of the first surface.

4. The sheet conveying device according to claim 1, wherein the structural member includes an electronic board, and wherein the plurality of through holes are located in the wall member at a position facing the facing surface of the structural member.

5. The sheet conveying device according to claim 4, wherein the electronic board includes a processor, and wherein at least a part of the plurality of through holes is located in the wall member at a position overlapping the processor of the electronic board when viewed in a direction in which the through holes extend through the first surface and the second surface of the wall member.

6. The sheet conveying device according to claim 1, wherein each of the plurality of through holes is oval and has a first dimension in the conveying direction and a second dimension in a direction perpendicular to the conveying direction and parallel to the first surface, the first dimension being larger than the second dimension.

7. The sheet conveying device according to claim 1, wherein the plurality of through holes are located at a portion of an area of the wall member, the area extending in a direction perpendicular to the conveying direction and parallel to the first surface.

8. The sheet conveying device according to claim 1, wherein the first surface of the wall member faces the tray, and the wall member includes ribs protruding from the first surface toward the tray and extending along the conveying direction, the ribs and the through holes being located adjacent to each other.

9. The sheet conveying device according to claim 1, further comprising:

a motor; and a driven member to be driven by the motor, wherein the frame divides, from the second space, a third space in which the motor and the driven member are located.

10. A sheet conveying device comprising:

a tray;

a conveying unit configured to convey a sheet to the tray in a conveying direction;

a wall member having a first surface and a second surface opposite to the first surface, the first surface and the tray defining a first space;

a structural member having a facing surface which faces the second surface of the wall member; and a frame having a wall surface which defines, together with the second surface of the wall member and the facing surface of the structural member, a second space, wherein the wall member includes a perforated portion having a plurality of though holes through which the first space and the second space communicate with each other, the perforated portion having a surface segment which is a part of the second surface, the surface segment and the facing surface of the structural member being inclined relative to each other, and the plurality of through holes including a first through hole and a second through hole which are located at different positions in the conveying direction.

11. The sheet conveying device according to claim 10, wherein the facing surface of the structural member extends horizontally.

12. The sheet conveying device according to claim 10, wherein the plurality of through holes are arranged in a first row including the first through hole and in a second row including the second through hole, the first row and the second row being located at different positions in the conveying direction.

13. The sheet conveying device according to claim 10, wherein a distance between the surface segment of the perforated portion and the facing surface of the structural member varies in the conveying direction.

* * * * *